US009479853B1

(12) United States Patent
Marquette et al.

(10) Patent No.: US 9,479,853 B1
(45) Date of Patent: Oct. 25, 2016

(54) SOUND MACHINE AND FAN

(71) Applicants: Grant N. Marquette, Clearwater, MN (US); Wayne C. Marquette, Saint Michael, MN (US)

(72) Inventors: Grant N. Marquette, Clearwater, MN (US); Wayne C. Marquette, Saint Michael, MN (US)

( * ) Notice: Subject to any disclaimer, the term of this patent is extended or adjusted under 35 U.S.C. 154(b) by 0 days.

(21) Appl. No.: 14/884,851

(22) Filed: Oct. 16, 2015

(51) Int. Cl.

| | |
|---|---|
| ***H04R 1/02*** | (2006.01) |
| ***F04D 29/52*** | (2006.01) |
| ***F04D 25/08*** | (2006.01) |
| ***F04D 19/00*** | (2006.01) |
| ***F04D 25/06*** | (2006.01) |
| ***F04D 29/32*** | (2006.01) |
| ***F04D 29/70*** | (2006.01) |
| ***F04D 29/38*** | (2006.01) |

(52) U.S. Cl.
CPC ..... *H04R 1/028* (2013.01); *F04D 19/002* (2013.01); *F04D 25/06* (2013.01); *F04D 25/08* (2013.01); *F04D 29/325* (2013.01); *F04D 29/388* (2013.01); *F04D 29/522* (2013.01); *F04D 29/703* (2013.01); *H04R 1/025* (2013.01)

(58) Field of Classification Search
CPC .. F04D 19/002; G10K 15/04; F24F 2221/38; F24F 2011/0067; G05B 15/02; F04B 35/04
USPC ..... 348/151
See application file for complete search history.

(56) References Cited

U.S. PATENT DOCUMENTS

| | | | | | |
|---|---|---|---|---|---|
| 5,322,979 | A * | 6/1994 | Cassity | H04R 1/023 | 181/150 |
| 5,448,495 | A * | 9/1995 | Liu | G06F 1/183 | 361/679.48 |
| 5,448,645 | A * | 9/1995 | Guerci | G10K 11/1788 | 381/71.14 |
| 6,244,823 | B1 * | 6/2001 | Marino | F04D 25/105 | 416/246 |
| 7,606,379 | B2 * | 10/2009 | Ivey | F21V 7/0008 | 381/160 |
| 8,625,833 | B1 * | 1/2014 | Armwood | H04R 25/00 | 381/370 |
| 8,763,750 | B1 * | 7/2014 | Berkman | H04R 1/021 | 181/150 |
| 2007/0034082 | A1 * | 2/2007 | Adair | B01D 45/06 | 96/63 |
| 2007/0290884 | A1 * | 12/2007 | Ishimoto | G08C 17/02 | 340/13.24 |
| 2008/0087329 | A1 * | 4/2008 | Chin | F04D 29/582 | 137/338 |
| 2008/0248714 | A1 * | 10/2008 | Zacharias | A63H 33/006 | 446/228 |
| 2008/0307796 | A1 * | 12/2008 | Bell | F24F 5/0042 | 62/3.4 |
| 2010/0101418 | A1 * | 4/2010 | Augustine | A61G 13/108 | 95/273 |
| 2012/0142999 | A1 * | 6/2012 | Albu | A47G 9/0215 | 600/26 |
| 2012/0222548 | A1 * | 9/2012 | Lev | F24F 6/12 | 95/1 |
| 2012/0274767 | A1 * | 11/2012 | Hornback | H04R 1/025 | 348/143 |
| 2014/0142888 | A1 * | 5/2014 | Duncan | F03D 7/0296 | 702/150 |
| 2014/0271286 | A1 * | 9/2014 | McNeill | G10K 15/04 | 417/423.1 |

OTHER PUBLICATIONS

"Portable Fan with built in speakers," Craziestgadgets.com, published Sep. 25, 2008.*

* cited by examiner

*Primary Examiner* — Dwayne J White
*Assistant Examiner* — Joshua R Beebe
(74) *Attorney, Agent, or Firm* — Dave Alan Lingbeck

(57) ABSTRACT

A sound machine and fan for providing selectable sounds including possibly circulating air as sleep aids. The sound machine and fan includes a fan assembly including a support member, an actuator mounted to the support member and having a rotatable shaft, and also including fan blades in operable communication with the actuator and the rotatable shaft; and a sound-producing assembly including speakers in communication with the fan assembly and a control unit in operable communication with the speakers and the actuator for producing desired sounds for effective sleep aids.

4 Claims, 4 Drawing Sheets

SOUND MACHINE AND FAN

BACKGROUND OF THE INVENTION

1. Field of the Invention

The present invention relates to sound and fan devices and more particularly pertains to a new sound machine and fan for providing selectable sounds including possibly circulating air as sleep aids.

2. Description of the Prior Art

The use of sound and fan devices is known in the prior art. More specifically, sound and fan devices heretofore devised and utilized are known to consist basically of familiar, expected and obvious structural configurations, notwithstanding the myriad of designs encompassed by the crowded prior art which have been developed for the fulfillment of countless objectives and requirements.

The prior art includes an improved-customizability digital sound relaxation system having a sound card receiving port and a collectable sound card are cooperative to play prerecorded natural or other sounds by depressing one of a plurality of sound selector switches and a sound card selector switch. Another prior art includes a fan with a stereo. The fan comprises a supporting rod, a motor arranged at the top of the supporting rod, fan blades arranged on a motor rotating shaft, a base arranged at the bottom end of the supporting rod, a fan switch arranged on the base, the stereo arranged on the fan blades and a stereo switch arranged on the base. describes an audio equipped fan having a housing defining an inner cavity, a motor disposed at least partially in the inner cavity of the housing and having an output shaft extending therefrom that is rotatable by the motor, a fan connected to the output shaft of the motor and rotatable therewith, a grille connected to the housing and positioned in alignment with the fan, the grille having an interior side and an exterior side and defining first openings through which air may flow while the fan is rotated and second openings through which sound may travel, and having a speaker connected to at least one of the housing, motor, fan and grille and aligned on the interior side of the grille with the second openings of the grille so that sound may travel from the speaker through the grille. yet, another prior art includes a fan with a sound device to efficiently use a narrow space of a desk by integrating the sound device and a lighting device to the fan. A fan comprises a nozzle, an air flow generating unit, a housing, and a sound device. The air flow generating unit generates air flow passing through the nozzle and is arranged inside the housing. The sound device is arranged inside the housing and comprises an input terminal, output devices, and a control part. The input terminal inputs music files. The output devices output music. The control part selects the desired music and plays the selected music. While these devices fulfill their respective, particular objectives and requirements, the aforementioned patents do not disclose a new sound machine and fan.

SUMMARY OF THE INVENTION

The general purpose of the present invention, which will be described subsequently in greater detail, is to provide a new sound machine and fan which has many of the advantages of the sound and fan devices mentioned heretofore and many novel features that result in a new sound machine and fan which is not anticipated, rendered obvious, suggested, or even implied by any of the prior art sound and fan devices, either alone or in any combination thereof. The present invention includes a fan assembly including a support member, an actuator mounted to the support member and having a rotatable shaft, and also including fan blades in operable communication with the actuator and the rotatable shaft; and a sound-producing assembly including speakers in communication with the fan assembly and a control unit in operable communication with the speakers and the actuator for producing desired sounds for effective sleep aids. None of the prior art includes the combination of the elements of the present invention.

There has thus been outlined, rather broadly, the more important features of the sound machine and fan in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new sound machine and fan which has many of the advantages of the sound and fan devices mentioned heretofore and many novel features that result in a new sound machine and fan which is not anticipated, rendered obvious, suggested, or even implied by any of the prior art sound and fan devices, either alone or in any combination thereof.

Still another object of the present invention is to provide a new sound machine and fan for providing selectable sounds including possibly circulating air as sleep aids.

Still yet another object of the present invention is to provide a new sound machine and fan that combines selectable sounds and circulating air all in one convenient unit to aid one's sleep.

Even still another object of the present invention is to provide a new sound machine and fan that is structured to provide surround sound for a person's better night sleep.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
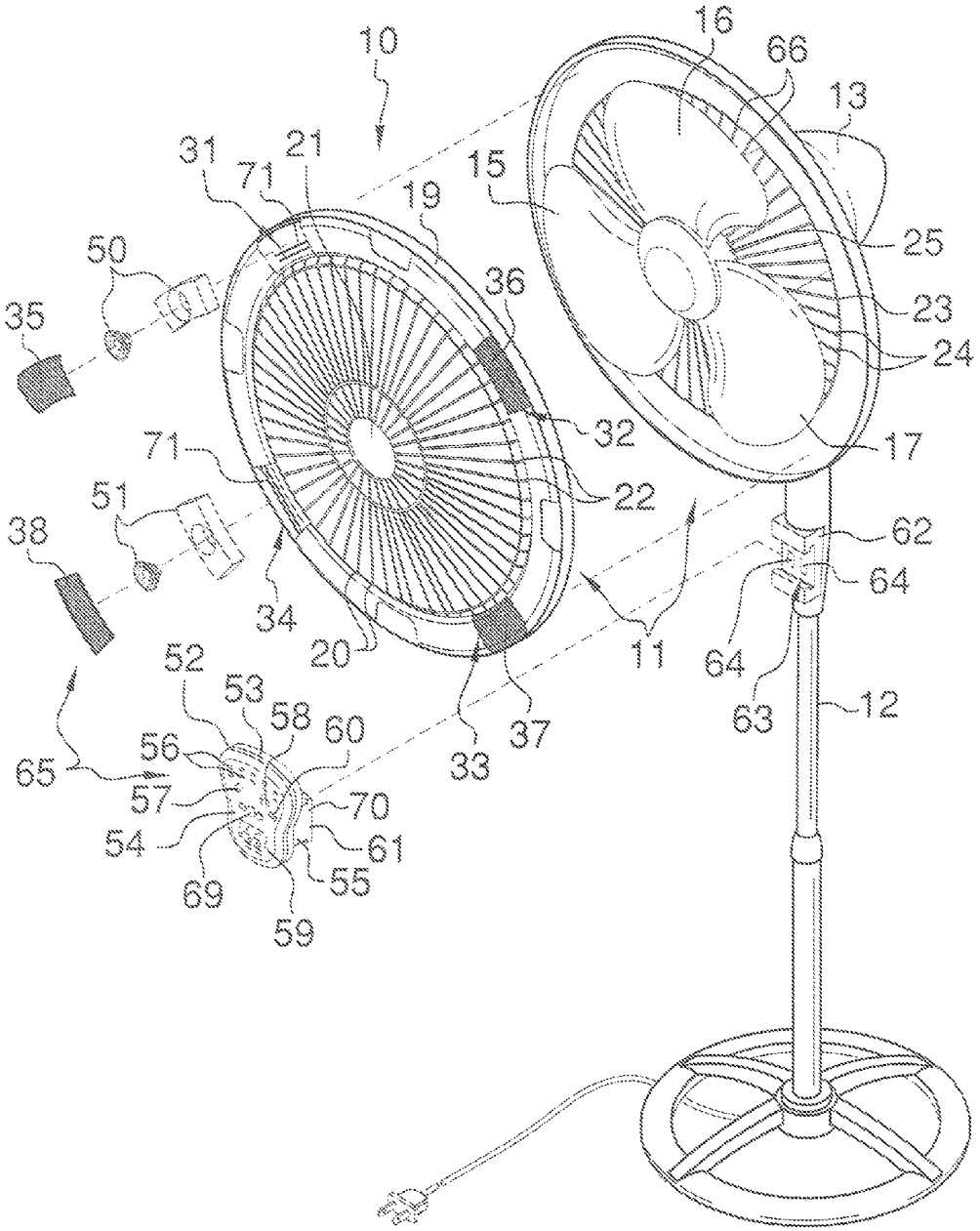
FIG. 1 is an exploded perspective view of a new sound machine and fan according to the present invention.

With reference now to the drawings, and in particular to FIGS. 1 through 4 thereof, a new sound machine and fan embodying the principles and concepts of the present invention and generally designated by the reference numeral 10 will be described.

As best illustrated in FIGS. 1 through 4, the sound machine and fan 10 may generally comprise a fan assembly 11 including a support member 12, an actuator 13 conventionally mounted to the support member 12 with a rotatable shaft 14, and also including fan blades 15-17 in operable communication with the actuator 13 and conventionally mounted to the rotatable shaft 14 for rotation therewith; and may also comprise a sound-producing assembly 65 including speakers 50, 51 in communication with and conventionally mounted to the fan assembly 11 and a control unit 52 in operable communication with and conventionally connected to the speakers 50, 51 and the actuator 13 for producing desired sounds for effective sleep aids along with air currents generated from the fan blades 15-17; whereupon the sounds may comprise of nature sounds including ocean sounds or man-made sounds which include white noises to relieve a user's stress and to effect a better night's sleep.

Figure 2:
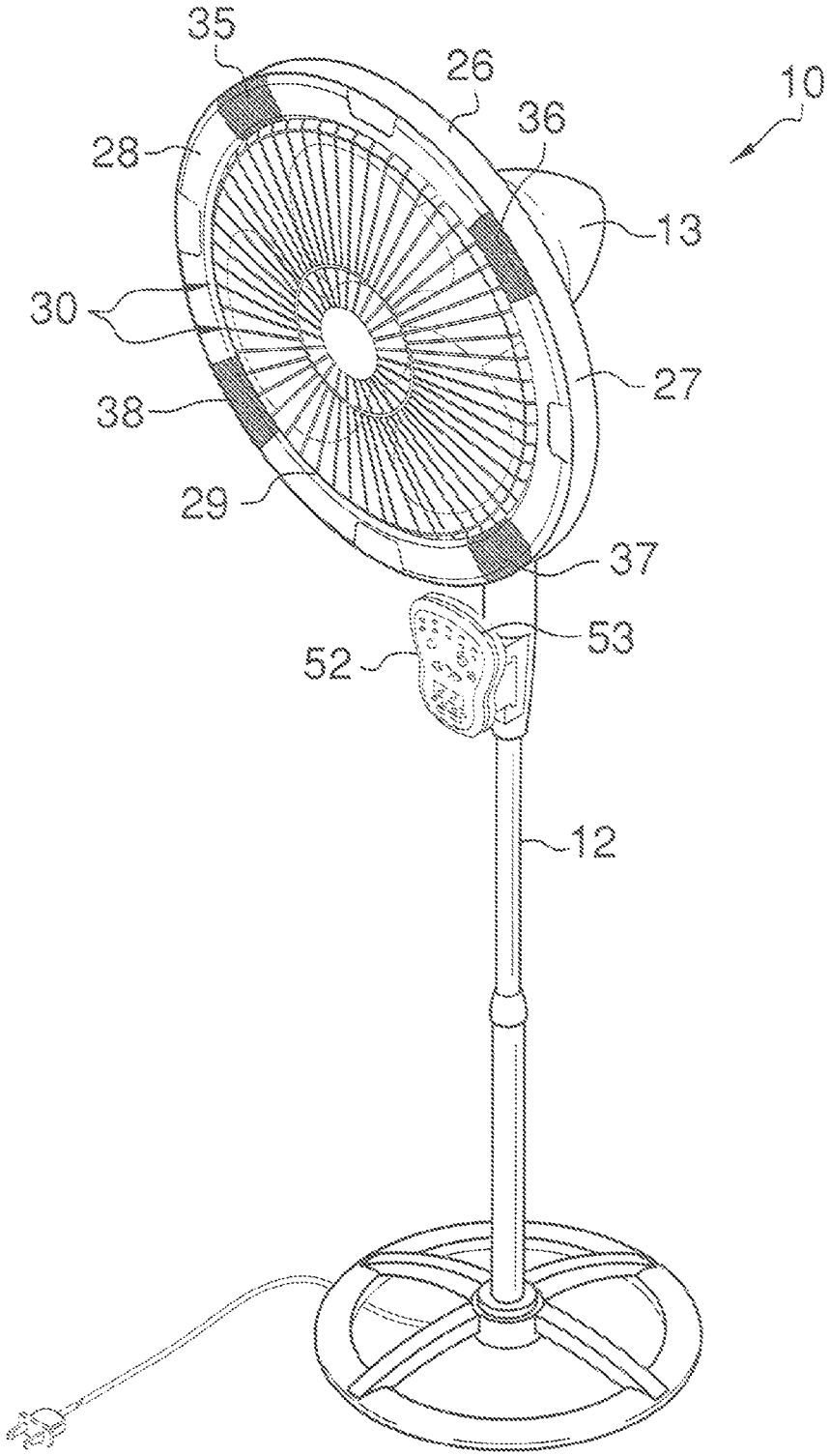
FIG. 2 is a perspective view of the present invention.
Figure 3:
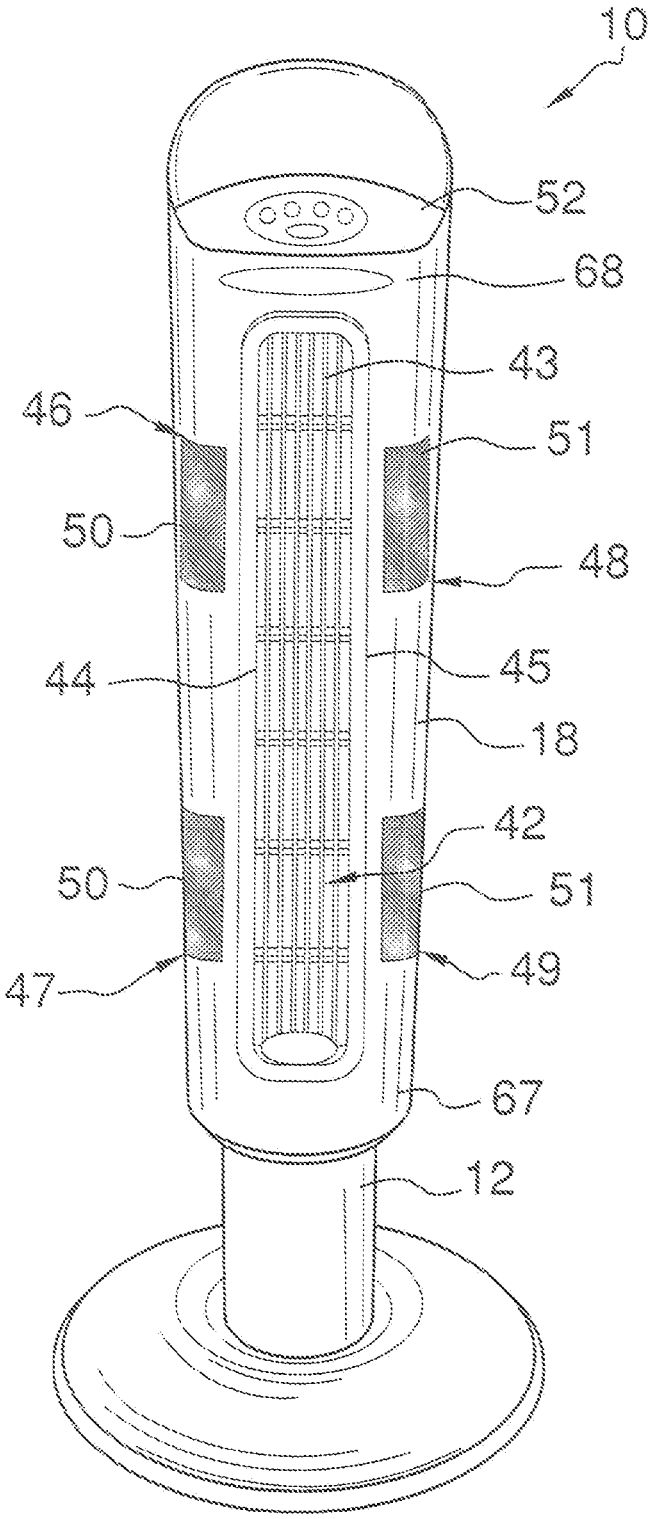
FIG. 3 is a perspective view of a second embodiment of the present invention.

As shown in FIGS. 1-3, the fan assembly 11 may further include a rigid fan housing 18 made of any suitable material and removably and circumferentially enclosed about the fan blades 15-17. The fan housing 18 may include a front grill section 19 and a back grill section 23. The speakers 50, 51 are conventionally supported upon the front grill section 19. The front grill section 19 may include front spokes 20 conventionally attached to and radially extending from a front hub 21. The back grill section 23 may include back spokes 24 conventionally attached to and radially extending from a back hub 25. The fan housing 18 may further include a hollow ring-shaped tube 26 having front 28, outer 27 and inner 29 walls with holes 30 spaced along and disposed in the inner wall 29 and circumferentially disposed 360 degrees about the front and back grill sections. The front and back spokes 20, 24 have outer ends 22, 66 which are disposed in a plurality of the holes 30 in the inner wall 29 of the ring-shaped tube 26. The ring-shaped tube 26 may have slots 31-34 disposed therein through the outer, front and inner walls 27-29 and spaced along the ring-shaped tube 26 and circumferentially disposed and spaced about the front and back grill sections 19,23. The slots 31-34 may terminate at the outer ends 22, 66 of the front and back spokes 20, 24 adjacent to the slots 31-34. The speakers 50, 51 which may include woofers and casings for the woofers are disposed and seated in the ring-shaped tube 26 of the fan housing 18 through the slots 31-34 of the ring-shaped tube 26 and circumferentially disposed and spaced about the front and back grill sections 19,23. The sound-producing assembly 65 may also include flexible sound permeable protective covers 35-38 preferably made of fabric and removably and conventionally disposed over the slots 31-34 and over the speakers 50, 51 and may further include wires 71 disposed inside the ring-shaped tube 26 and conventionally interconnecting the speakers 50, 51.

As a second embodiment and shown in FIG. 3, the fan housing 18 may have a front side 54 and an opening 42 disposed through the front side 54 and may extend near a bottom 67 of the fan housing 18 to near a top 68 of the fan housing 18. The speakers 50, 51 are conventionally supported upon the fan housing 18. The fan assembly 11 may further include a grill 43 securely and conventionally disposed in the opening 42 of the fan housing 18. The fan housing 18 may have first slots 46, 47 disposed therethrough and adjacent to and spaced along a longitudinal edge 44 of the grill 43 and may further have second slots 48, 49 disposed therethrough and adjacent to and spaced along an opposed longitudinal edge 45 of the grill 43. The speakers 50, 51 may be conventionally disposed in the fan housing 18 through the first and second slots 46-49 adjacent to the longitudinal edges 44, 45 of the grill 43.

Figure 4:
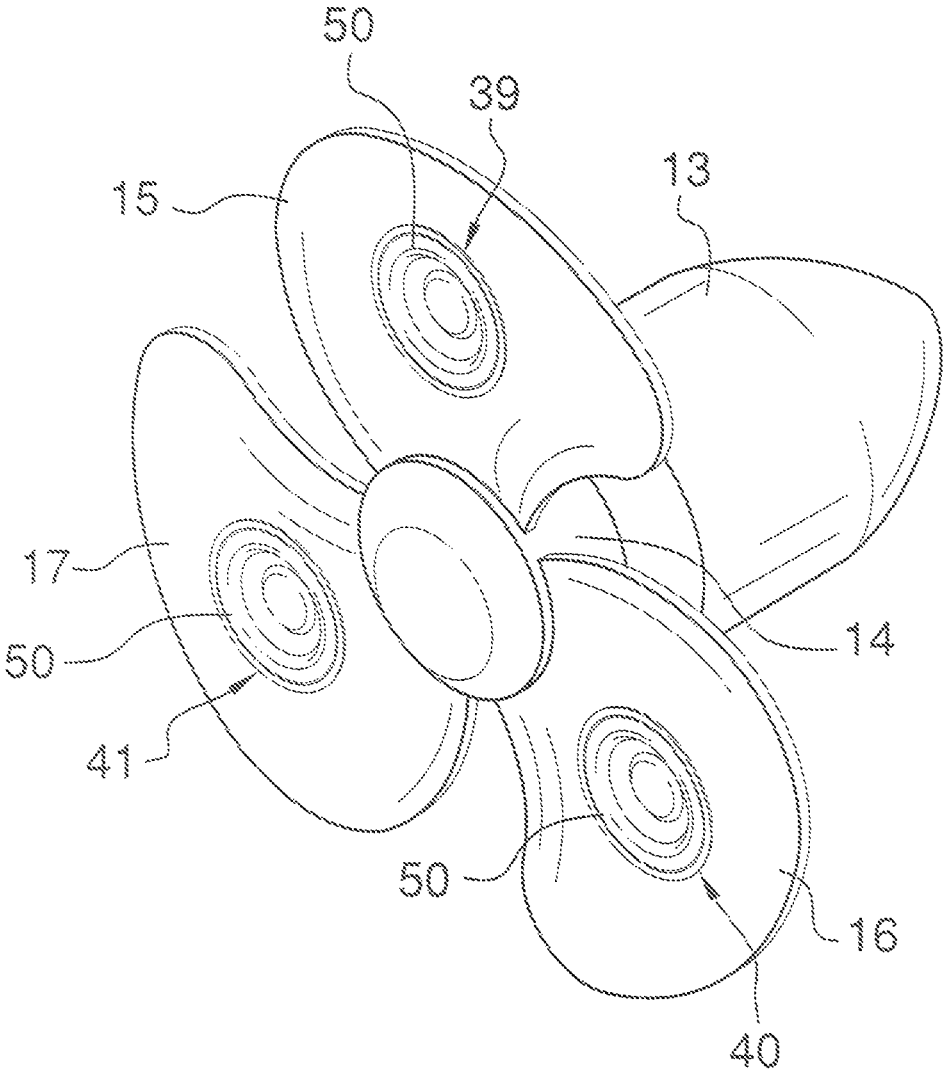
FIG. 4 is a perspective view of a third embodiment of the present invention.

As a third embodiment and shown in FIG. 4, each of the fan blades 15-17 may have openings 39-41 centrally disposed therethrough with the speakers 50 conventionally supported upon the fan blades 15-17. The speakers 50 may be securely and conventionally disposed in the openings 39-41 of the fan blades 15-17.

As shown in FIGS. 1-3, the control unit 52 may include a housing member 53 having a front side 54 and may also include a microprocessor 55 conventionally disposed in the housing member 53 and programmed with sounds and in conventional communication with the speakers 50, 51 using the wires 71 disposed in the ring-shaped tube 26 or wireless transmitters and receivers and may further include sound selector switches 56 and a volume control switch 59 conventionally disposed upon the front side 54 of the housing member 53 and in operable and conventional communication with the microprocessor 55 for a user to choose the desired sound and volume as a sleep aid. The control unit 52 may further include an input jack 60 disposed in the housing member 53 and in operable and conventional communication with the microprocessor 55 for connecting to a sound device to transmit sound from the sound device through the microprocessor 55 to the speakers 50, 51 as desired. The control unit 52 may also include a wireless receiver 61 conventionally disposed in the housing member 53 and in operable and conventional communication with the microprocessor 55 for receiving radio signals from a sound device having a compatible wireless transmitter to transmit desired sounds to the microprocessor 55 and to the speakers 50, 51. The control unit 52 may also include two power switches 57, 58 adapted to be connected to a conventional power source and conventionally disposed upon the front side 54 of the housing member 53 with one of the power switches 57 in operable and conventional communication with the actuator 13 and the other of the power switches 58 in operable and conventional communication with the microprocessor 55 for energizing the actuator to actuate the fan blades 15-17 and the microprocessor 55 for producing the desired sound as a sleep aid. The control unit 52 may further include fan speed selector switches 69 conventionally disposed upon the front side 54 of the housing member 53 and in operable and conventional communication with the actuator 13 to control the speed of the rotating fan blades 15-17. As an alternate embodiment, the housing member 53 of the control unit 52 may be detachably mounted to the support member 12. The support member 12 may have electrical contacts 64 connectable to the control unit 52 to energizably interconnect the control unit 52 to the speakers 50, 51 and the actuator 13. The fan assembly 11 may include a bracket 62 conventionally mounted to the support member 12 and having a slot 63 disposed therein with the electrical contacts 64 conventionally seated in the slot 63 and supported by the bracket 62. The housing member 53 may have a back side 70 which is removably received in the slot 63 for making direct operable contact with the electrical contacts 64 for communicating with the actuator 13 and the speakers 50, 51.

In use, the user may set up the sound machine and fan 10 preferably in an area where the user would usually sleep and that would normally be one's bedroom and would connect the combo apparatus 10 to a power source such as an electrical outlet unless the power source is a battery unit integrated to the combo apparatus 10 and may power the fan blades 15-17 and use the noise from the actuator 13 and the fan blades 15-17 along with the air from the fan blades 15-17 to function as a sleep aid or power the microprocessor 55 to transmit the desired sound from the microprocessor 55 through the speakers 50, 51 or power both the fan blades 15-17 and the microprocessor 55 concurrently to create the white noise to aid the user's sleep or may, since the white noise effectively cancels out any outside noises and provides a uniform consistent noise to which the user gets accustomed to and is able to sleep without be aroused from other unusual and unexpected sounds.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the sound machine and fan. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A sound machine and fan comprising:

a fan assembly including a support member, an actuator mounted to the support member, wherein the fan assembly further includes a fan housing, wherein the fan housing includes a front grill section and a back grill section, wherein the front grill section includes front spokes radially extending from a front hub, and the back grill section includes back spokes radially extending from a back hub, wherein the fan housing also includes a hollow ring-shaped tube with an outer wall, a front wall and an inner wall, wherein the ring-shaped tube is coupled to outer ends of the front and back spokes and is circumferentially disposed about the front and back grill sections, wherein the ring-shaped tube has slots disposed therein through the outer, front and inner walls of the ring-shaped tube and spaced along the ring-shaped tube and circumferentially disposed and spaced 360 degrees about the front and back grill sections; and a sound-producing assembly including speakers in communication with the fan assembly and a control unit in operable communication with the speakers and the actuator for producing desired sounds for effective sleep aids.

2. The sound machine and fan as described in claim 1, wherein the slots terminate at the outer ends of the front spokes.

3. The sound machine and fan as described in claim 1, wherein the speakers are disposed in the ring-shaped tube of the fan housing through the slots of the ring-shaped tube and circumferentially disposed and spaced about the front and back grill sections, wherein the sound-producing assembly also includes flexible sound permeable protective covers disposed over the slots and over the speakers and further includes wires disposed inside the ring-shaped tube and interconnecting the speakers.

4. The sound machine and fan as described in claim 1, wherein the ring-shaped tube has holes disposed in and spaced along the inner wall, wherein the outer ends of a plurality of the front and back spokes are received in the holes and support the ring-shaped tube.

* * * * *